United States Patent [19]

Nilsson

[11] 4,136,572

[45] Jan. 30, 1979

[54] DEVICE FOR INCREMENTAL FEED IN A MACHINE TOOL

[75] Inventor: Bengt E. Nilsson, Lidköping, Sweden

[73] Assignee: Lidköpings Mekaniska Verkstads AB, Lidköping, Sweden

[21] Appl. No.: 803,871

[22] Filed: Jun. 6, 1977

Related U.S. Application Data

[63] Continuation of Ser. No. 601,824, Aug. 4, 1975, abandoned.

[30] Foreign Application Priority Data

Aug. 14, 1974 [SE] Sweden ..... 7410346

[51] Int. Cl.[2] ..... F16H 29/00

[52] U.S. Cl. ..... 74/125.5; 192/85 AA

[58] Field of Search ..... 74/125.5; 51/165.8, 51/165.81, 165.9; 192/85 AA

[56] References Cited

U.S. PATENT DOCUMENTS

| | | | |
|---|---|---|---|
| 263,032 | 8/1882 | Emerson et al. | 192/85 AA |
| 1,879,633 | 9/1932 | Olsen et al. | 192/85 AA |
| 2,066,131 | 12/1936 | White | 74/125.5 |
| 3,334,881 | 8/1967 | Hunt | 74/125.5 |
| 3,714,837 | 2/1973 | Jensen et al. | 74/125.5 |

*Primary Examiner*—Benjamin W. Wyche
*Assistant Examiner*—Wesley S. Ratliff, Jr.
*Attorney, Agent, or Firm*—Daniel M. Rosen

[57] ABSTRACT

A device for incremental feed of the tool or workpiece in a machine tool of the kind in which feed is effected with a device having at least one rotating shaft, characterized by a rotating element fixed to the rotating shaft, a releasable coupling element and elements for moving the coupling element, the coupling element being situated so as to interact with the rotating element at a distance from the shaft in such a way that when the coupling element is engaged with the rotating element, the latter is rotated and thus effects a rotary motion of the shaft.

12 Claims, 3 Drawing Figures

DEVICE FOR INCREMENTAL FEED IN A MACHINE TOOL

This is a continuation, of application Ser. No. 601,824, filed Aug. 4, 1975 now abandoned.

The present invention relates to a device for incremental feed of the tool or workpiece in a machine tool of the kind in which feed of the tool or workpiece is accomplished by means of a device comprising at least one rotating shaft.

When grinding on a grinder, for example, it is very important that the wheelhead can be finely adjusted in order to compensate for changes in the grinding wheel dimensions occuring when dressing the grinding wheel. When precision grinding, feed of the wheelhead must be effected in extremely small steps, often of the order of 1 μm, if a satisfactory machining result is to be obtained. Further, the possibility of rapid feed of the wheelhead is desired, for example when changing the grinding wheel, when, however, the fine adjustment mechanism must be disengaged.

To achieve small feed increments of the wheelhead, it is already known that a one-way clutch, preferably designed as a so-called free-wheel clutch, can be attached to a rotating spindle in the feed system. This clutch is connected to a drive unit which can execute small forward or backward movements, whereby the clutch is engaged for movement in one direction and transmits a rotary motion to the spindle, and is disengaged for movement in the other direction as the drive unit is returning to the initial position. Such a device can effect incremental feed of the wheelhead in one direction at desired increments, but an additional feed device is required for precision feed in the opposite direction. In addition, the one-way clutch would have to be capable of being completely disengaged to allow rapid feed and return, this resulting in a complicated machine.

It is also known that an electrically driven so-called step motor, which can execute small rotary motions in both directions and thus effect precision feed of the wheelhead, can be coupled to a rotating spindle in the feed system. Such a motor, however, is already complicated itself and, furthermore, would have to be capable of being completely disengaged from the feed system when the latter is used for rapid feed or return; this means that the device becomes even more complicated. Further, known incremental feed devices are generally connected to some kind of gearing which connect them with the rotating spindle in the feed system, this resulting in additional expense.

With a device in accordance with the present invention, the features of which appear in the patent claims, a satisfactory precision feed of tools or workpieces in a machine tool is made possible in a simple manner and with simple means. In addition, rapid feed and return are made possible without having to provide the device with special disengagement elements.

Referring to the accompanying drawings, this invention is described in detail in the following.

Figure 1:
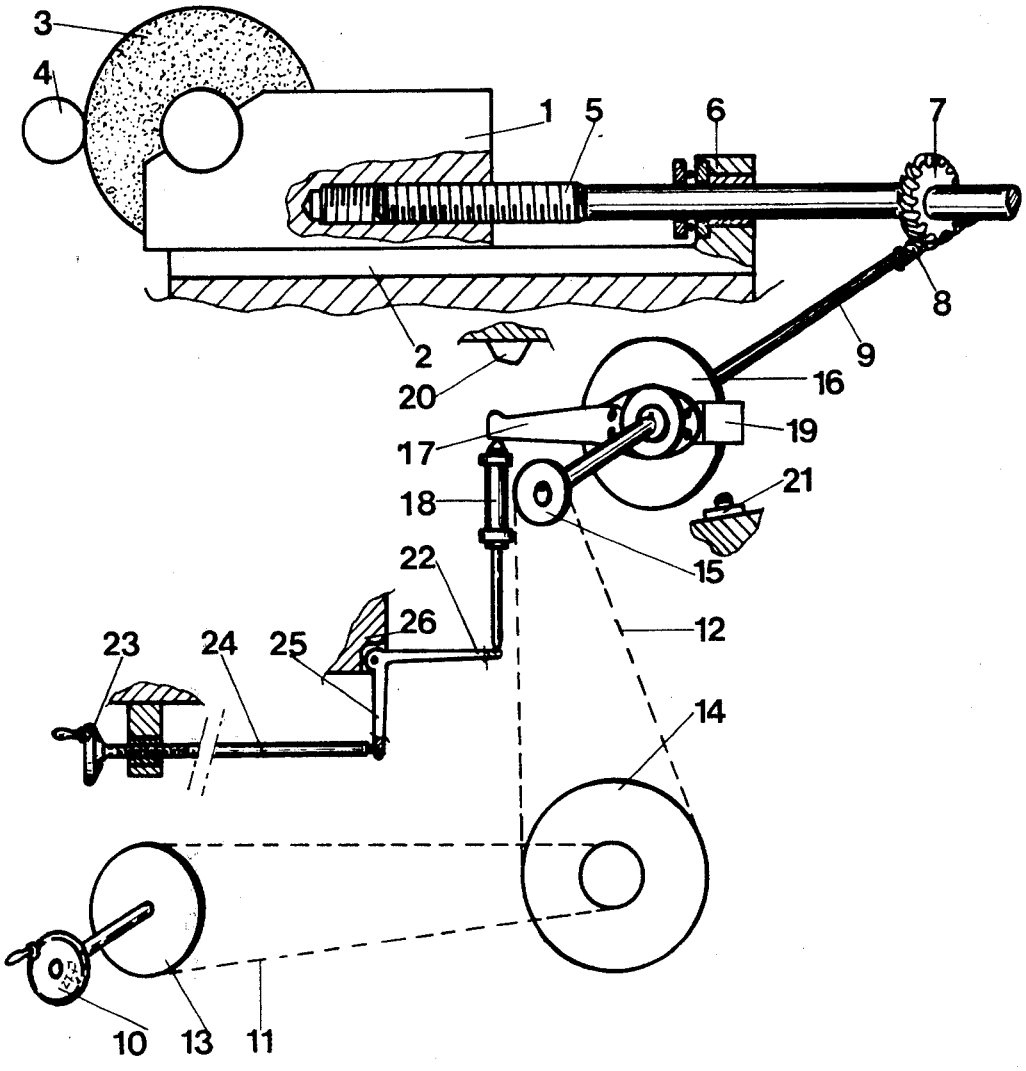
FIG. 1 shows a diagrammatic sketch of a feed device for a wheelhead, including an incremental feed device in accordance with a more detailed embodiment of this invention.

Referring to FIG. 1, a wheelhead 1 which can be slid linearly on a bed 2 is shown. A grinding wheel 3 is rotatably mounted on the wheelhead 1 and is driven by a motor, which is not shown. A workpiece is indicated by 4. For the linear feed of the wheelhead 1, the wheelhead is provided with a threaded bore in which a screw 5 with a corresponding thread is situated. This screw is mounted in a bracket 6 so as to allow rotation and is held axially. When the screw 5 is turned in one direction or the other, the wheelhead 1 is moved forwards or backwards. To achieve the desired rotary motion of the screw 5, one end is connected to a backlash-free worm gear with gear elements 7 and 8, where gear element 7 is firmly connected to spindle 5, and gear element 8 is firmly connected to another shaft 9. Shaft 9 is driven by means of a feed handwheel 10 via chain drives with chains 11 and 12, and sprockets 13, 14, and 15. Manual feed, mainly rapid feed, of the wheelhead 1 is accomplished by turning the handwheel 10. Depending on the direction in which handwheel 10 is turned, the wheelhead is moved forwards or backwards.

To achieve slower feed of the wheelhead, the feed system is provided with an incremental feed device which includes a rotating element firmly attached to shaft 9, this element having the form of a circular disk whose plane is perpendicular to the shaft and whose center coincides with the center of the shaft. Further, a holder in the form of a lever 17, which is attached to shaft 9 in such a manner as to allow free rotation, is adjacent to this disk. One end of this lever is connected to a pressure-actuated piston and cylinder device 18 which brings about a rotary motion of the lever 17 as the result of extension or retraction. The other end of the lever is provided with a coupling element 19, which is described in more detail in connection to FIGS. 2 and 3. The lever 17 can be engaged with or disengaged from the disk 16 as desired by coupling element 19. Rotation of disk 16 and thus of shaft 9, which effects feed of wheelhead 1, can thus be achieved by extension or retraction of the piston and cylinder device 18 in a known manner, and by simultaneously engaging or disengaging the coupling element 19, which effects feed or return by extension or retraction, respectively, of the piston and cylinder device 18 at the same time as the coupling element is engaged.

Rotation of the lever 17 is limited in one direction by stationary stop elements 20 and 21, which interact with appropriate surfaces on the lever. These stop elements are combined in an appropriate way with sensing and pulse-generating elements, which serve to control the piston and cylinder device 18 and/or the coupling element 19.

Figure 3:
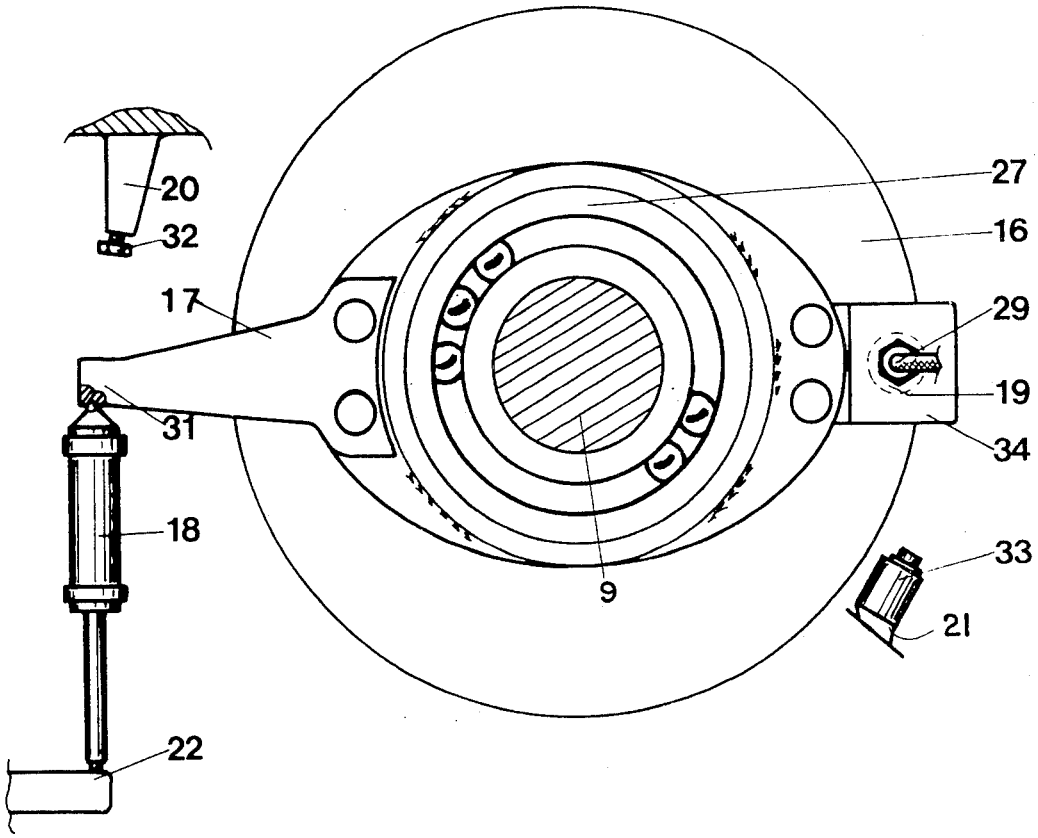

The angle of rotation of the lever can be controlled by adjusting a swivel arm 22, one end of such as the switch 33 of FIG. 3, which is connected to the piston and cylinder device 18, and whose position in relation to the stop element 20 can be controlled by a shaft 24, which is movable axially by a handwheel 23. The shaft 24 is connected to a lever 25, which is mounted in a stationary bearing 26 and rigidly connected to the arm 22. If the distance between the stop element 20 and the arm 22 increases the stroke of the piston and cylinder device 18 also increases, which means that the angle of rotation of the lever 17 increases. This, in turn, means that the size of the feed increment with regard to wheelhead 1 increases.

When coupling element 19 is disengaged, the entire incremental feed device is disengaged, and manual feed of the wheelhead can be effected by turning the handwheel 10.

Figure 2:
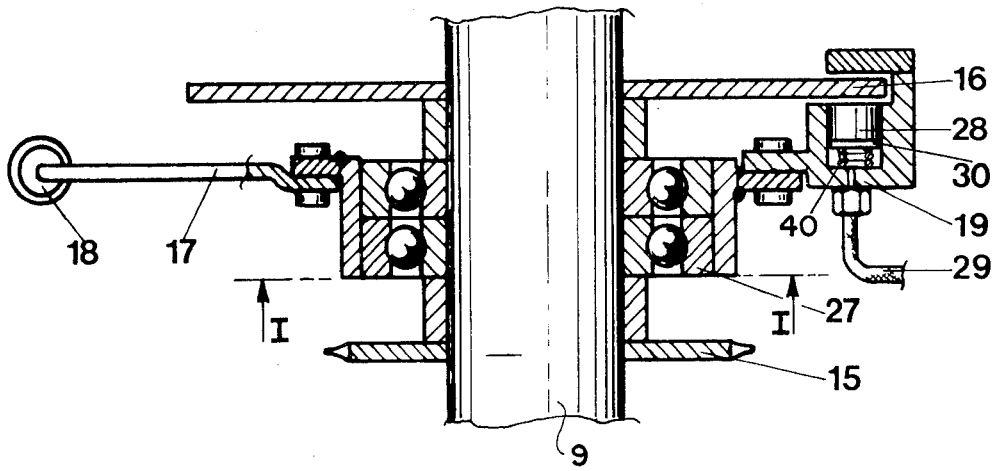
FIGS. 2 and 3 show an embodiment of this precision feed device on an enlarged scale.

FIGS. 2 and 3 are a cross-section and side elevation, respectively, of one embodiment of details of the incremental feed device. A sprocket 15 and disk 16 are fixed to the shaft 9, and a lever 17 is supported in bearings 27 on the shaft 9. A piston and cylinder device 18 is attached to one end of the lever in a manner which has already been described, while a coupling element 19 is attached at the other end. In the embodiment shown here, the coupling element comprises a bracket which fits over a part of the disk 16 and one of whose arms holds a clamping element in the form of a piston 28 which can move axially in relation to the disk 16 inside a cylindrical chamber 30, which is connected to a hydraulic line 29. If hydraulic fluid is fed into the chamber 30, the piston 28 is pressed against a face of the disk 16 and a firm connection between the lever 17 and disk 16 results. If the pressure in chamber 30 is released, the piston 28 is moved into a free position in an appropriate manner by means of a spring 40 so that the disk 16 and shaft 9 can be freely rotated in relation to the lever 17 and coupling element 19. To limit the rotary motion of the lever 17 a stationary stop element 20 is so placed on the stop element 21 that it interacts with an opposite surface 31 on the lever 17. Adjustment of the stop position can, for example, be accomplished by installing an adjustable stop screw 32 in the stop element 20. To control the flow of the hydraulic agent to device 18 and/or to chamber 30, a switch 33 is so placed that it can interact with an opposite surface 34 on the lever 17. As already described, the stroke of device 18 can be controlled by adjusting the position of arm 22.

Embodiments of the device for turning disk 16 other than the design described above are, of course, also conceivable within the scope of the patent claims.

As an example of the operation of the device, assume that, in FIG. 1, the wheel head is driven to the left when the shaft 9, and hence the disk 16, are turned clockwise. Assume further that the device 18 is fully retracted, and that the handwheel 23 has been preset to provide a desired feed increment. If, now, the devices 18 and 19 are simultaneously actuated, the lever 17 will be driven clockwise, and hence, due to the frictional coupling by the device 19, and disk 16 and shaft 9 will also be driven clockwise. This effects the drive of the wheelhead 1 to the left. The drive continues in this direction, under the control of the device 18, until the surfaces 31 and 34 of the lever 17 engage the screw 32 and switch 33. The consequent actuation of the switch 33 can be employed to release the coupling 19, and effect the retraction of the device 18, so that the initial position of the system is attained. If, on the other hand, it was desired to incrementally feed the wheelhead in the opposite direction, the device 18 is actuated to rotate the lever 17, without the simultaneous actuation of the device 19. In this case, when the surface 34 contacts the switch 33, the device 18 can be retracted, and simultaneously the device 19 will be actuated to frictionally couple the lever 17 to the disk 16. As a consequence, the disk 16 will now be driven in the counterclockwise direction, to increment the wheelhead to the left. The control of the devices 18 and 19 may be effected by any conventional technique, such as electric or pneumatic controls.

In addition, the feed of a wheelhead need not necessarily be effected with the device; the feed of other tools is also conceivable and, furthermore, feed of the workpiece instead of the tool is possible.

What we claim is:

1. In an incremental feed device for a tool or workpiece in a machine tool, wherein the machine tool has a rotatable shaft and feed of said tool or workpiece is effected by rotation of the rotatable shaft; the improvement comprising a circular disk mounted concentrically on said rotatable shaft for rotation therewith, lever means pivotally mounted on the axis of said shaft and adjacent said circular disk, stop means positioned to limit angular displacement of said lever in one direction, linear acting drive means having first and second ends, the first end thereof being coupled to move said lever means into and out of engagement with said stop means, adjustable position mounting means coupled to pivotally support the second end of said linear acting drive means, and selectively operable coupling means mounted to couple said lever means to said circular disk, and rotary drive means connected to said shaft.

2. The feed device of claim 1, wherein said coupling means comprises pressure-actuated clamping means on said lever means and positioned to engage said circular disk.

3. The feed device of claim 1, wherein said linear acting drive means comprises a pressure-actuated piston and cylinder device.

4. The device of claim 1, further comprising switching means mounted at the end position of movement of said lever means for providing a signal responsive to the engagement of said lever means with said stop means.

5. The incremental feed device of claim 1, wherein said drive means comprises a piston-cylinder, and further comprising means for adjusting the position of said piston-cylinder whereby the amplitude of said incremental feed may be adjusted.

6. The incremental feed device of claim 5, wherein said coupling means comprises a piston-cylinder means affixed to said lever adjacent the periphery of said circular disk with the piston thereof mounted for axial movement to engage said circular disk, whereby the periphery of said disk may be frictionally coupled to said lever means, and spring means for resiliently biasing said last-mentioned piston away from said circular disk.

7. The incremental feed device of claim 5, further comprising switch means positioned to engage said lever means at a position corresponding to the stop position of said lever means defined by said stop means.

8. The incremental feed device of claim 1 wherein said adjustable position mounting means comprises a threaded shaft coupled to adjust the position of said second end of said linear acting drive means.

9. The incremental feed device of claim 8 comprising manual feed means for said threaded shaft.

10. The incremental feed device of claim 9 comprising pivoted lever means coupling said second end of said linear acting drive means to said threaded shaft.

11. The incremental feed device of claim 8 wherein said rotary drive means comprises manually operable drive means coupled to rotate said rotatable shaft.

12. The incremental feed device of claim 1 wherein said adjustable position mounting means comprising continuously adjustable positioning means for said second end of said linear acting drive means, and manually operable means for adjusting said positioning means, whereby the relative incremental feed of said feed device may be adjusted to be of any magnitude.

* * * * *

UNITED STATES PATENT AND TRADEMARK OFFICE

CERTIFICATE OF CORRECTION

PATENT NO. : 4,136,572

DATED : 1/30/79

INVENTOR(S) : B.E.Nilsson

It is certified that error appears in the above-identified patent and that said Letters Patent are hereby corrected as shown below:

Col. 2, line 48 - After "elements", insert --such as the switch 33 of Fig.3,--.

Col. 2, lines 52-53 - Omit "such as the switch 33 of Fig. 3".

Col. 3, lines 22,23 - After "placed" omit "on the stop element 21 ."

Col. 3, line 28 - After "placed" insert --on the stop element 21--.

Col. 3, line 43 - Change "and" first occurrence to --the--.

Signed and Sealed this

*Seventeenth* Day of *June 1980*

[SEAL]

*Attest:*

SIDNEY A. DIAMOND

*Attesting Officer*

*Commissioner of Patents and Trademarks*